US006416338B1

(12) United States Patent
Berlovan

(10) Patent No.: US 6,416,338 B1
(45) Date of Patent: Jul. 9, 2002

(54) ELECTRICAL CONNECTOR WITH DUAL ACTION PISTON

(75) Inventor: Viorel Berlovan, Medina, OH (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/804,079

(22) Filed: Mar. 13, 2001

(51) Int. Cl.[7] ..... H01R 13/53
(52) U.S. Cl. ..... 439/187; 439/921
(58) Field of Search ..... 439/921, 853, 439/578, 584, 133, 589, 320, 801, 813, 805, 607, 693, 185, 187

(56) References Cited

U.S. PATENT DOCUMENTS

| | | | | |
|---|---|---|---|---|
| 3,617,987 A | | 11/1971 | Sankey | |
| 3,668,614 A | | 6/1972 | Ball | |
| 3,860,321 A | | 1/1975 | Ball | |
| 3,930,709 A | | 1/1976 | Stanger et al. | |
| 3,982,812 A | | 9/1976 | Boliver | |
| 4,008,943 A | | 2/1977 | Flatt et al. | |
| 4,119,358 A | | 10/1978 | Tachick et al. | |
| 4,186,985 A | | 2/1980 | Stepniak et al. | |
| 4,473,807 A | * | 9/1984 | Weber et al. | 333/206 |
| 4,583,809 A | * | 4/1986 | Werth et al. | 439/853 |
| 4,773,872 A | | 9/1988 | Borgstrom et al. | |
| 4,857,021 A | * | 8/1989 | Boliver et al. | 439/801 |
| 4,867,687 A | | 9/1989 | Williams et al. | |
| 5,215,475 A | | 6/1993 | Stevens | |
| 5,421,750 A | | 6/1995 | Crotty | |
| 5,445,533 A | | 8/1995 | Roscizewski et al. | |
| 5,857,862 A | | 1/1999 | Muench et al. | |
| 6,227,914 B1 | * | 5/2001 | Lee et al. | 439/754 |
| 6,261,126 B1 | * | 7/2001 | Stirling | 439/853 |

* cited by examiner

*Primary Examiner*—Neil Abrams
*Assistant Examiner*—J. F. Duverne
(74) *Attorney, Agent, or Firm*—Mark S. Bicks; Tara L. Hoffman; Alfred N. Goodman

(57) ABSTRACT

An electrical connector including a housing with an inner bore, a first end and a second end opposite the first end. The second end has an opening that provides access to the inner bore. A piston is received within the inner bore of the housing and includes a first sleeve and a second sleeve, the first and second sleeves being coaxial and slidably engaged in a telescoping arrangement. The first and second sleeves are movable between a retracted position and an extended position by sliding the first and second sleeves with respect to one another within the inner bore of the housing. A contact element is disposed on the second sleeve and movable with it between first and second axially spaced positions within the inner bore.

22 Claims, 3 Drawing Sheets

ELECTRICAL CONNECTOR WITH DUAL ACTION PISTON

FIELD OF THE INVENTION

The present invention generally relates to an electrical connector for a power distribution system. More specifically, the invention relates to an electrical connector, such as a bushing insert, having a dual action piston that moves between retracted and extended positions. During fault closure, the dual action piston hastens connection of the electrical connector with another electrical device of the power distribution system, thereby halting the formation of flashover or electrical arc.

BACKGROUND OF THE INVENTION

Conventional high voltage electrical connectors, such as bushing inserts, connect such devices as transformers to electrical equipment of a power distribution system. Typically, the electrical connector is connected to another electrical device of the power distribution system, such as a cable connector, with female contacts of the electrical connector mating with male contacts of the cable connector.

During a loadmake or connection of the electrical connector and the cable connector, an arc is struck between the contact elements as they approach one another. The arc formed during loadmake is acceptable since the arc is of generally moderate intensity and is quenched as soon as the contact elements are engaged. However, during fault closure, or short circuit conditions, a substantial arc can occur between the contact elements of the connectors resulting in catastrophic failure of the electrical connector including extensive damage and possible explosion.

Conventional electrical connectors employ a piston that moves the female contact of the electrical connector into engagement with the male contact of the cable connector during fault conditions, thereby hastening the engagement of the contacts, which in turn substantially eliminates any arc that has formed therebetween. As a result, however, the conventional electrical connectors must be adapted to accommodate the shape of the movable piston which must be of sufficient length to hasten the connection of the contacts elements and eliminate any arc.

Examples of conventional high voltage electrical connectors are disclosed in U.S. Pat. No. 3,930,709 to Stanger et al.; U.S. Pat. No. 3,982,812 to Boliver; U.S. Pat. No. 4,008,943 to Flatt et al.; U.S. Pat. No. 4,119,358 to Tachick et al.; U.S. Pat. No. 4,186,985 to Stepniak et al.; U.S. Pat. No. 4,773,872 to Borgstrom et al.; and U.S. Pat. No. 5,445,533 to Roscizewski et al.

SUMMARY OF THE INVENTION

Accordingly, an object of the present invention is to provide an electrical connector that includes a mechanism for hastening connection of the electrical connector with another electrical device, thereby substantially quenching the formation of any arc therebetween during fault conditions.

Another object of the present invention is to provide an electrical connector that includes a piston assembly for hastening connection of the electrical connector and another electrical device that is adapted to reduce the amount of space required by the electrical connector to accommodate the piston assembly.

Yet another object of the present invention is to provide an electrical connector that includes a piston assembly having telescoping members which move between retracted and extended positions to facilitate hastening the connection of the contact elements of the electrical connectors and reduce the size of the piston assembly.

The foregoing objects are basically attained by an electrical connector, comprising a housing that has an inner bore, a first end and a second end that is opposite the first end. The second end has an opening that provides access to the inner bore. A piston is received within the inner bore of the housing and includes a first sleeve and a second sleeve. The first and second sleeves are coaxial and slidably engaged in a telescoping arrangement, and are movable between a retracted position and an extended position by sliding the first and second sleeves with respect to one another within the inner bore of said housing. A contact element is on the second sleeve and movable therewith between first and second axially spaced positions within the inner bore.

The foregoing objects are also attained by an electrical connector assembly, comprising an electrical connector that includes a housing with an inner bore, a first end, and a second end opposite the first end. The second end has an opening providing access to the inner bore. A piston is received within the inner bore of the housing proximate the first end, and includes first and second sleeves coaxially and slidably engaged in a telescoping arrangement, and a contact element on the second sleeve that is movable therewith. An electrical device has a contact element that engages the contact element of the piston of the electrical connector. The first and second sleeves of the piston move between a retracted position and an extended position upon sliding the first and second sleeves with respect to one another within the inner bore of the housing of the electrical connector due to generation of internal gases upon mating of the electrical connector and the electrical device.

By fashioning the electrical connector in this manner, a dual action piston assembly both reduces the size of the electrical connector and provides an effective mechanism for hastening the connection of the contact elements of the electrical connector and an electrical device during a fault closure.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
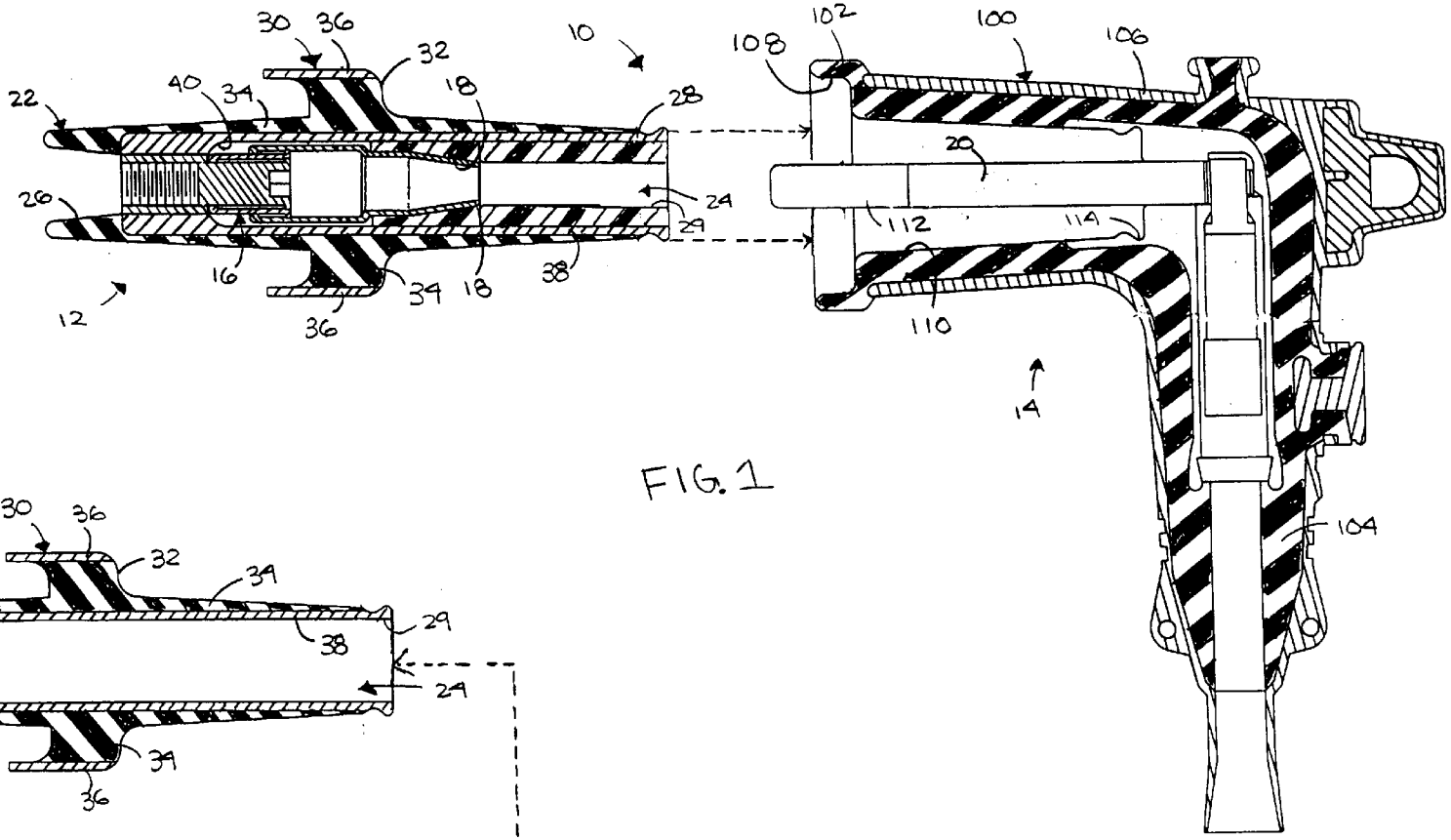
FIG. 1 is a side elevational view in section of an electrical connector being mated with an electrical device for a power distribution system in accordance with an embodiment of the present invention.

Referring to FIGS. 1–7, an electrical connector assembly 10 of a power distribution system, in accordance with the present invention, includes an electrical connector 12, such as a bushing insert, that is adapted to mate with an electrical device 14, such as a cable connector. Bushing insert 12 includes a piston 16 with a contact element 18 that engages a contact element 20 of cable connector 14. During fault closure, piston 16 moves contact element 18 toward contact element 20 of cable connector 14 to hasten the engagement thereof and quench any arc that may have formed while the two contact elements 18 and 20 were approaching engagement.

Figure 2:
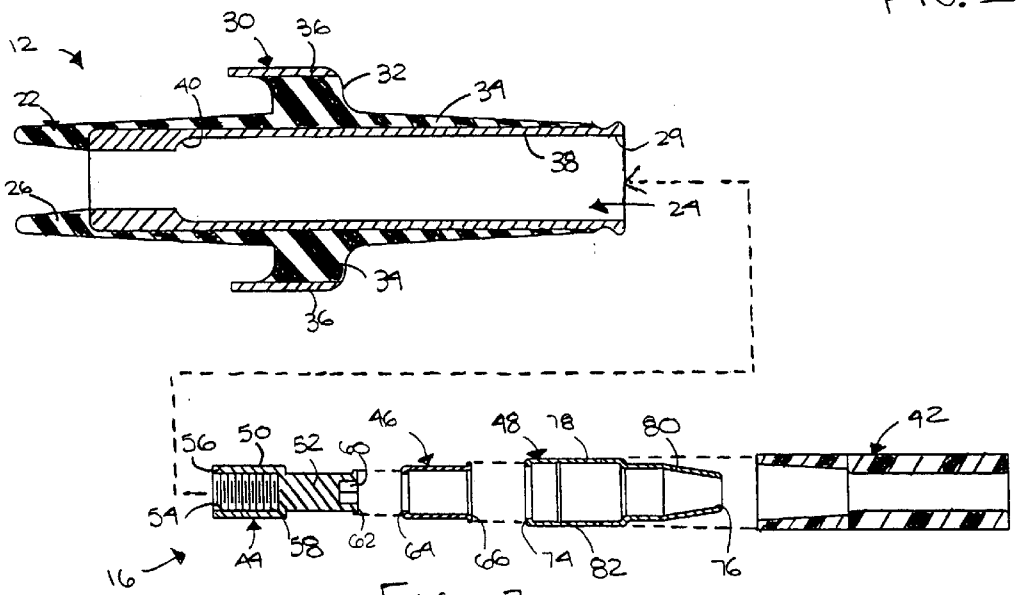
FIG. 2 is an exploded side elevational view in section of the electrical connector illustrated in FIG. 1.

Bushing insert 12 generally includes a housing 22 having an inner bore 24 that receives piston 16, as best seen in FIG. 2. Housing 22 specifically includes opposing first and second end portions 26 and 28, and a middle portion 30 that joins portions 26 and 28. First end portion 26 connects to a bushing well, second end portion 28 connects to cable connector 14 through an opening 29 to inner bore 24, and middle portion 30 connects to ground, as is well known in the art. First and second end portions 26 and 28 are generally circular cylindrical with a slight taper from middle portion 30 to each end of housing 22, respectively. The shape of second end portion 28, in particular, is adapted to fit within cable connector 14. Middle portion 30 is radially wider than first and second end portions 26 and 28 with a transition shoulder 32 between middle portion 30 and second end portion 28.

Housing 22 of bushing insert 12 is a one-piece member formed of an insulative body 34 with an outer conductive layer 36 at its middle portion 30, and an inner conductive casing 38 that defines inner bore 24. Outer layer 36 is preferably made of a conductive rubber, insulative body 34 is preferably made of an insulating rubber, and inner casing 38 is preferably made of a conductive rubber or nylon.

Figure 3:
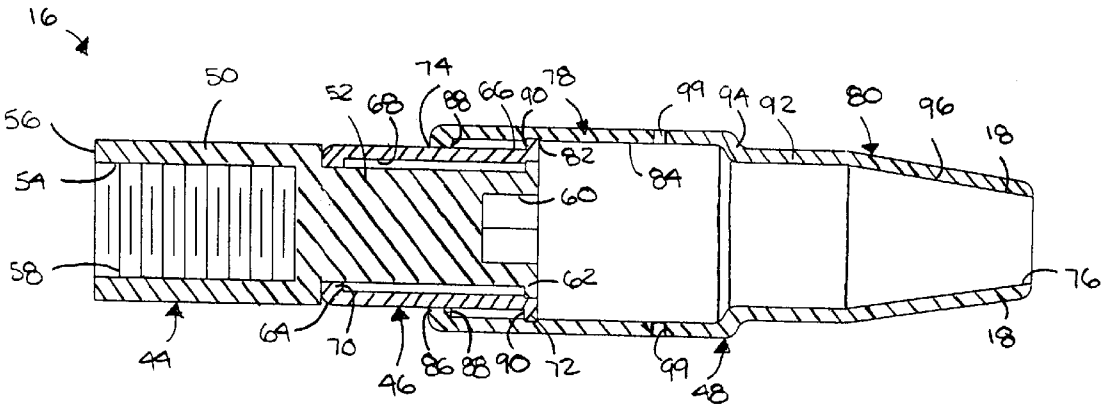
FIG. 3 is an enlarged side elevational view in section of the piston of the electrical connector illustrated in FIG. 1, showing the piston in its retracted position.
Figure 4:
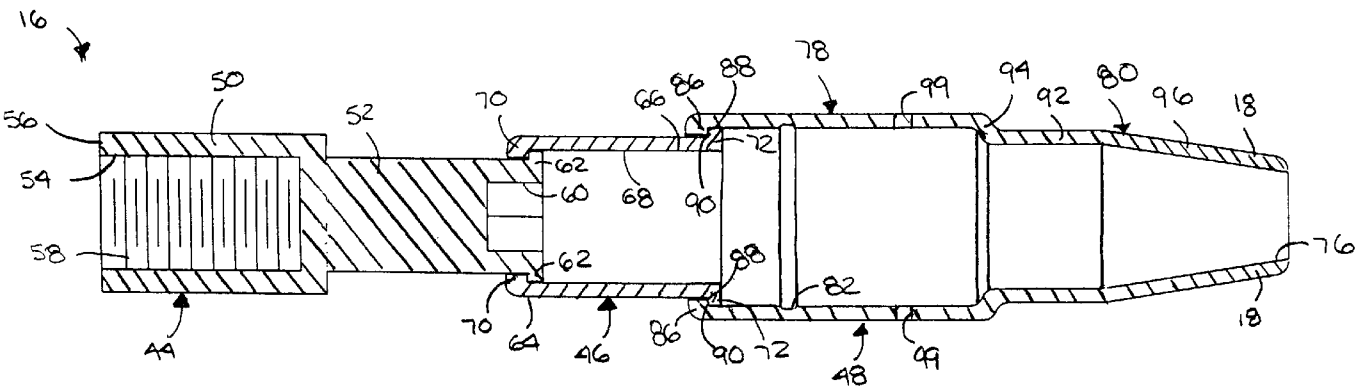
FIG. 4 is an enlarged side elevational view in section of the piston of the electrical connector illustrated in FIG. 1, showing the piston in its extended position.

Within inner bore 24 of housing 22 is piston 16 which is received in a piston chamber 40. As seen in FIGS. 2–4, piston 16 generally includes a base 44, an inner sleeve 46, and an outer sleeve 48 with inner and outer sleeves 44 and 46 being engaged in a telescoping manner. Sleeves 46 and 48 slide with respect to each other between retracted and extended positions. Piston 16 is made of any conductive material, preferably metal. An albative member 42 is coupled with outer sleeve 46 at contact element 18 so that albative member 42 slides with sleeve 46 with respect to inner casing 38. Albative member 42 provides arc extinguishing gases, as is known in the art.

Piston base 44 is a unitary one-piece member with first and second substantially cylindrical sections 50 and 52 with second section 52 having a smaller radial or lateral dimension than first section 50. First section 50 is fixedly attached to inner casing 38 and includes a cavity 54. The cavity is accessed through its distal end 56 and has internal threads 58 for connection to a bushing well (not shown). Second section 52 includes end opening 60 opposite end 54 of first section 50 that receives a tool which rotates bushing insert 12 for installation into the bushing well. Surrounding end opening 60 is a radially outwardly extending stopping lip 62 that provides a stop for inner sleeve 46.

Inner sleeve 46 is supported by second section 52 of base 44. Inner sleeve 46 is a unitary one-piece generally uniform tubular member with first and second opposing open ends 64 and 66. Inner sleeve 46 fits over second section 52 of base 44 and includes an inner sliding surface 68 allowing sleeve 46 to slide with respect to base 44. A radially inwardly extending stopping lip 70 is disposed at first end 64 of inner sleeve 46 and a radially outwardly extending stopping lip 72 is disposed at second end 66. Inwardly extending stopping lip 70 abuts stopping lip 62 of base 44 when piston 16 is in its extended position, as seen in FIG. 4.

Outer sleeve 48 is also a unitary one-piece generally tubular member that is supported by inner sleeve 46. In particular, outer sleeve 48 has a first open end 74, a second open end 76 opposite first open end 74, and first and second portions 78 and 80 therebetween. First portion 78 fits over inner sleeve 46; and second portion 80 is adapted to receive contact element 20 of cable connector 14. First portion 78 includes a generally uniform inner diameter except for a circumferential notch 82 disposed in an inner surface 84 of portion 78. A radially inwardly extending stopping lip 86 is disposed at its first open end 74 and has an inner abutting surface 88. Second portion 80 of outer sleeve 48 includes a generally uniform section 92 with a shoulder 94 extending between uniform section 92 and first portion 78. A tapered or conical section 96 extends from uniform section 92 and forms contact element 18 of bushing insert 12. Holes 99 can be provided in either portion 78 and 80 of outer sleeve 48 to provide access to piston chamber 40.

As seen in FIG. 3, when in the retracted position, substantially all of base 44 is received within inner sleeve 46 and a substantial portion of inner sleeve 46 is received within outer sleeve 48. In addition, outwardly extending lip 72 of inner sleeve 46 engages notch 82 of outer sleeve 48, thereby maintaining sleeves 46 and 48 in the retracted position. As seen in FIG. 4, when in the extended. position, substantially all of base 44 is outside of inner sleeve 46, and likewise substantially all of inner sleeve 46 is outside of outer sleeve 48, thereby extending the length of piston 16 by sliding inner sleeve 46 with respect to base 44 and outer sleeve 48, and sliding outer sleeve 48 with respect to inner sleeve 46. Also, inner abutting surface 88 of outer sleeve 48 abuts an outer abutting surface 90 of outwardly extending lip 72 of inner sleeve 46 when sleeves 46 and 48 are in the extended position.

Although it is preferable to fashion the telescoping arrangement of inner and outer sleeves 46 and 48 in the manner described above, any type of telescoping or sliding arrangement can be employed to extend the length of piston 16. For example, the opposite arrangement of that described above can be employed where sleeve 46 slides within sleeve 46 and sleeve 46 slides within base 44. Alternatively, sleeve 48 can slide with respect to the inner surface of inner casing 38 with an outwardly extending lip providing a catch for stopping the movement of sleeve 46 when the desired position is reached. Another alternative includes eliminating one of the sleeves 46 and 48 so that only a single sleeve slides with respect to base 44 between retracted and extended positions. Also, any number of sleeves, i.e., more than just inner and outer sleeves 46 and 48, can be employed.

By forming piston 16 with sleeves 46 and 48 in a telescoping arrangement where one sleeve is received in another sleeve, the overall length and size of piston 16 is substantially less than conventional pistons. Therefore, since less area is required to accommodate piston 16, the size and length of bushing insert 12 can be reduced.

Bushing insert 12 connects to cable connector 14. Since cable connector 14 is well known in the art, it will be described only generally. Cable connector 14 includes an insulative housing 100 with first and second ends 102 and 104, and an outer conductive jacket 106, as best seen in FIG. 1. First end 102 includes an opening 108 for receiving bushing insert 12 into a bushing port 110 of connector 14. Extending through bushing port 110 is contact element or conductive probe 20 which is received within outer sleeve 48 of bushing insert piston 16, through conical section 96, upon connection of bushing insert 12 and cable connector 14. Probe 20 includes an albative member 112 to provide arc quenching gases, as is known in the art. Bushing port 110 is shaped to receive second end portion 28 of insert 12 with a groove 114 that mates with an extended lip 98 of bushing end portion 28. Second end 104 of cable connector 14 receives a cable that is electrically connected to probe 20. Although cable connector 14 is shown as an elbow or L-shaped connector, bushing insert 12 can be connected to any type of cable connector known in the art.

Figure 5:
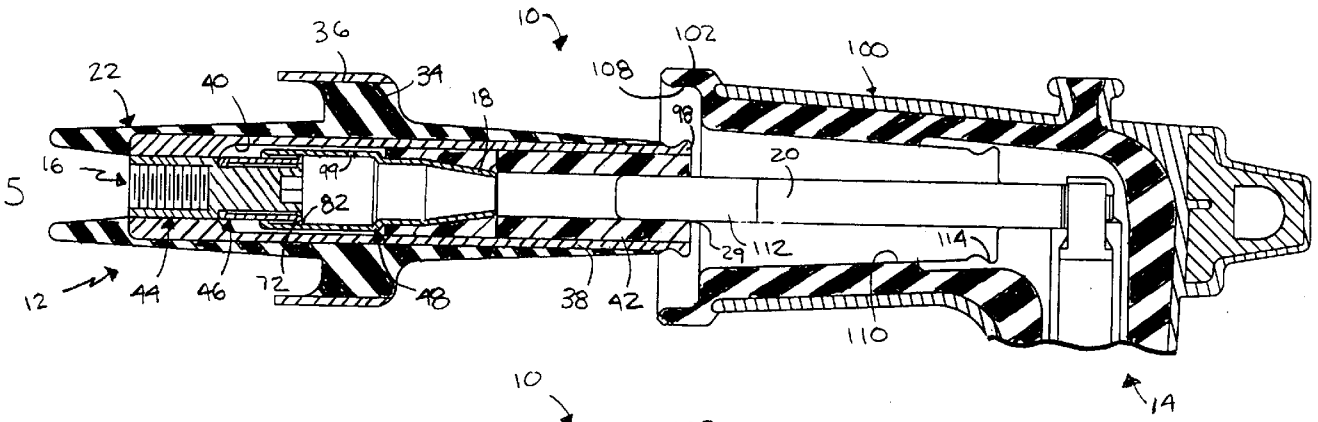
FIG. 5 is a partial side elevational view in section of the electrical connector being mated with the electrical device illustrated in FIG. 1, showing the piston in its retracted position.
Figure 6:
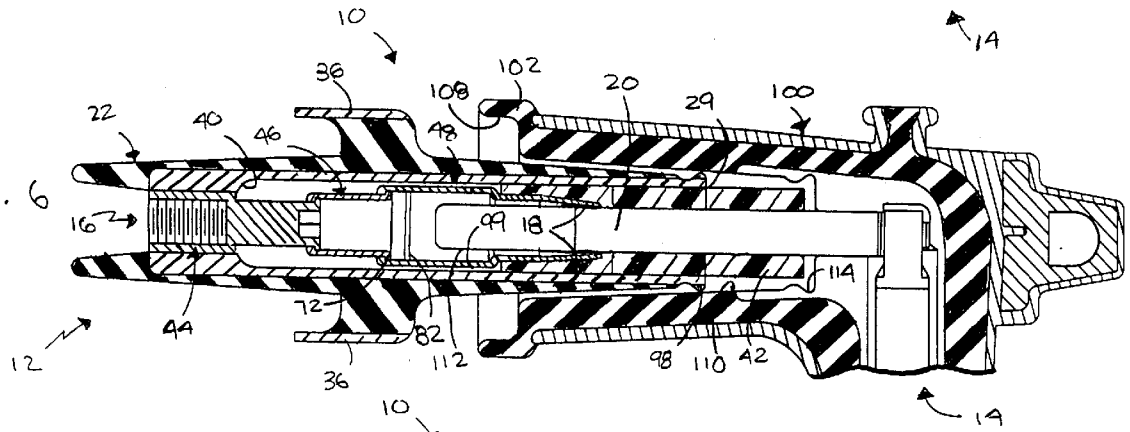
FIG. 6 is a partial side elevational view in section of the electrical connector partially mated with the electrical device illustrated in FIG. 1, showing the piston actuated to its extended position.
Figure 7:
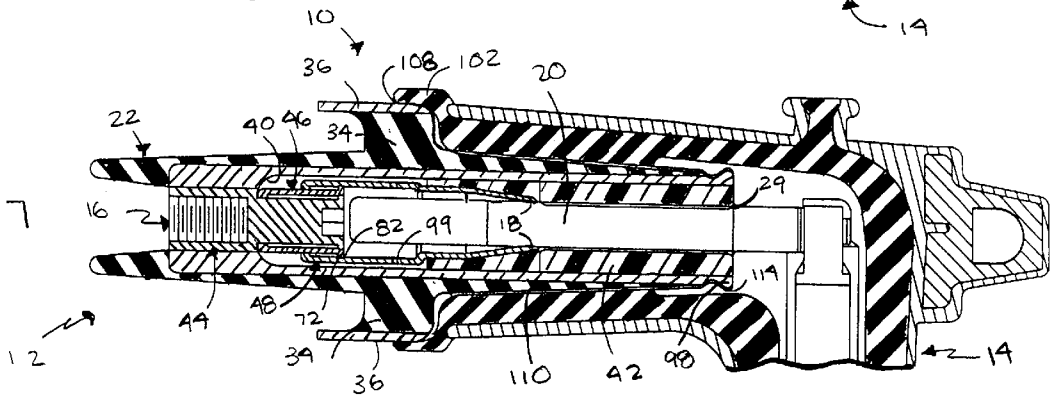
FIG. 7 is a partial side elevational view in section of the electrical connector fully mated with the electrical device illustrated in FIG. 1, showing the piston returned to its retracted position.

Referring to FIGS. 5–7, by moving from a retracted position to an extended position, piston 16 hastens the connection of contact element 18 of bushing insert 12 and contact element 20 of cable connector 14, thereby quenching the formation of arc during fault closure.

As seen in FIG. 5, as bushing insert 12 and cable connector 14 approach one another, with bushing insert 12 being inserted into bushing port 110 of connector 14, an arc is formed between contact elements 18 and 20 triggering the generation of arc quenching gases from albative members 42 and 112, as is known in the art. Inner and outer sleeves 46 and 48 of piston 16 are initially in their normal retracted position with outwardly extending stopping lip 72 of inner sleeve 46 resting in notch 82 of outer sleeve 48.

As seen in FIG. 6, as bushing insert 12 is moved further into bushing port 110 of connector 14, the generated gases from ablative members 42 and 112 fill up piston chamber 40 of bushing insert 12 either by passing through holes 99 in outer sleeve 48 or around outer sleeve 48. Because of the great intensity of the arc formed during a fault closure, the generated gases will be greater than under normal conditions resulting in enough pressure in piston chamber 40 to force inner and outer sleeves 46 and 48 to their extended position toward cable connector 14. In particular, inner sleeve 46 will slide with respect to piston base 44 toward cable connector 14. Also, outer sleeve 48 will slide with respect to inner sleeve 46, thereby releasing stopping lip 72 from notch 82 of outer sleeve 48. In addition, albative member 42 is forced toward cable connector 14 and through bushing opening 29. Outer sleeve 48 with contact element 18 of bushing insert 12 engages contact element 20 of connector 14 before bushing insert 12 is fully inserted into bushing port 110 of cable connector 14, thereby causing the arc formed due to the fault, to be eliminated.

As seen in FIG. 7, when bushing insert 12 is fully mated within bushing port 110 of connector 14, inner and outer sleeves 46 and 48 of piston 16 return to their retracted position with albative member 42 also sliding back into inner bore 24 of bushing insert 12.

Under normal operating conditions, that is other than fault conditions, the intensity of the arc is moderate and thus does not create enough pressure in piston chamber 40 to move inner and outer sleeves 46 and 48. In addition, lip 72 of inner sleeve 46 received in notch 82 of outer sleeve 48 prevents outer sleeve 48 from moving during normal conditions since the pressure in piston chamber 42 is not enough to force outer sleeve 46 toward bushing opening 29 and lip 72 out of notch 82. Thus, it is generally only under fault conditions that inner and outer sleeves 46 and 48 will slide between retracted and extended positions.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a housing having an inner bore, a first end and a second end opposite said first end, said second end having an opening providing access to said inner bore;

a piston received within said inner bore of said housing and including a first sleeve and a second sleeve, said first and second sleeves being coaxial and slidably engaged in a telescoping arrangement and being movable between a retracted position and an extended position by sliding said first, and second sleeves with respect to one another within said inner bore of said housing; and a contact element on said second sleeve and movable therewith between first and second axially spaced positions within said inner bore.

2. An electrical connector according to claim 1, wherein said first sleeve is received in said second sleeve.

3. An electrical connector according to claim 2, wherein in said retracted position, said first sleeve is substantially fully received in said second sleeve; and in said extended position, said first sleeve extends substantially outside of said second sleeve.

4. An electrical connector according to claim 3, wherein said contact moves in a direction towards said opening of said housing in said extended position.

5. An electrical connector according to claim 1, wherein said inner bore of said housing includes a piston chamber receiving said piston and internal gases of said electrical connector to fill said piston chamber and force said piston from said retracted position to said extended position.

6. An electrical connector according to claim 5, wherein said housing includes an albative member, said albative member generating said internal gases in the presence of an arc.

7. An electrical connector according to claim 1, wherein said first sleeve is slidably disposed on a base located within said inner bore of said housing near said first end.

8. An electrical connector according to claim 7, wherein in said retracted position, said base is substantially fully received in said first sleeve, and said sleeve is substantially fully received in said second sleeve; and in said extended position when said base is substantially received outside of said first sleeve, and said first sleeve extends substantially outside of said second sleeve.

9. An electrical connector according to claim 7, wherein said base is fixed with respect to said housing.

10. An electrical connector according to claim 1, wherein said housing is formed of an insulative material.

11. An electrical connector according to claim 1, wherein said second sleeve and said contact element are formed as a one-piece unitary member.

12. An electrical connector, comprising;

a housing having an inner bore;

a piston assembly received within said inner bore of said housing, said piston assembly including first and second radially spaced sleeves, said first sleeve having a first sliding surface and a first abutting surface, said second sleeve having a second sliding surface and a second abutting surface, and said first and second sliding surfaces move relative to each other between a retracted position when said first abutting surface is spaced form said second abutting surface, and in an extended position when said first and second abutting surfaces are engaged; and a contact element on said second sleeve and movable therewith between first and second axially spaced positions within said inner bore.

13. An electrical connector, comprising:

a housing having an inner bore;

a piston assembly received within said inner bore of said housing, said piston assembly including first and second sleeves, said first sleeve having a first sliding surface and a first abutting surface, said second sleeve having a second sliding surface and a second abutting surface, and said first and second sliding surfaces move relative to each other between a retracted position when said first abutting surface is spaced form said second abutting surface, and in an extended position when said first and second abutting surfaces are engaged;

a contact element on said second sleeve and movable therewith between first and second axially spaced positions within said inner bore; and said first sleeve is received in said second sleeve.

14. An electrical connector according to claim 13, wherein said first sleeve of said piston is slidably disposed on a base located within said inner bore of said housing.

15. An electrical connector according to claim 14, wherein said first sleeve slides with respect to said second sliding surface; and said second sleeve slides with respect to said first sliding surface.

16. An electrical connector assembly, comprising:

an electrical connector including, a housing having an inner bore, a first end, and a second end opposite said first end, said second end having an opening providing access to said inner bore, and a piston received within said inner bore of said housing proximate said first end, and including first and second sleeves coaxially and slidably engaged in a telescoping arrangement, and a contact element on said second sleeve and movable therewith; and an electrical device having a contact element engaged with said contact element of said piston of said electrical connector, whereby said first and second sleeves of said piston are movable between a retracted position and an extended position upon sliding said first and second sleeves with respect to one another within said inner bore of said housing of said electrical connector due to generation of internal gases upon mating of said electrical connector and said electrical device.

17. An electrical connector assembly according to claim 16, wherein said first sleeve of said piston is slidably received in said second sleeve.

18. An electrical connector assembly according to claim 16, wherein said electrical device includes a bushing port that receives said second end of said electrical connector; and said contact element of said electrical device is disposed within said bushing part.

19. An electrical connector assembly according to claim 18, wherein said electrical connector is a bushing insert having an outer conductive jacket and an inner insulative layer that defines said inner bore.

20. An electrical connector according to claim 19, wherein said electrical device is a cable connector; and said contact element of said cable connector is a conductive probe that extends through said opening of said bushing insert and is received in said second sleeve of said piston.

21. An electrical connector according to claim 12, wherein one of said first and second sleeves is slidably received in the other of said first and second sleeves.

22. An electrical connector according to claim 13, wherein said first sleeve is directly coupled with said second sleeve.

* * * * *